United States Patent [19]

Downing

[11] Patent Number: 4,848,016

[45] Date of Patent: Jul. 18, 1989

[54] ILLUMINATED SIGN SYSTEM

[75] Inventor: David G. Downing, Surrey, Canada

[73] Assignee: P.O.P Inc., British Columbia, Canada

[21] Appl. No.: 102,022

[22] Filed: Sep. 28, 1987

[30] Foreign Application Priority Data

Dec. 5, 1986 [CA] Canada ..... 530052

[51] Int. Cl.[4] ..... G09F 13/04

[52] U.S. Cl. ..... 40/575; 40/572

[58] Field of Search ..... 40/575, 574, 576, 152.1, 40/572, 571, 564, 610, 611, 124.2, 159

[56] References Cited

U.S. PATENT DOCUMENTS

| | | | |
|---|---|---|---|
| 1,455,474 | 6/1922 | Brown | 40/576 |
| 2,587,434 | 6/1946 | Boaden et al. | 40/159 |
| 2,622,356 | 8/1950 | Valente | 40/575 |
| 2,725,913 | 4/1953 | Horwin | 40/159 |
| 2,734,295 | 6/1951 | Fewster et al. | 40/472 |
| 4,292,752 | 4/1979 | Clark | 40/576 |

FOREIGN PATENT DOCUMENTS

| | | | |
|---|---|---|---|
| 1058247 | 11/1963 | United Kingdom | 40/606 |

*Primary Examiner*—Gene Mancene
*Assistant Examiner*—Cary E. Stone
*Attorney, Agent, or Firm*—Christie, Parker & Hale

[57] ABSTRACT

Existing illuminated signs required skilled workers to replace or change the sign face. The present sign system allows the illuminated faces to be rapidly and easily changed by non-skilled workers. Transparent or translucent plastic envelopes are used to support color transparencies which form the sign faces. The envelopes are easily slipped into and out of the display position. The sign system is particularly suited for use as point-of-purchase advertising in grocery store aisle markers.

6 Claims, 6 Drawing Sheets

ILLUMINATED SIGN SYSTEM

BACKGROUND OF THE INVENTION

The invention relates to sign systems, and in particular illuminated sign systems.

Existing sign systems typically consist of a rectangular extruded metal frame supporting on one or both sides a translucent display face of rigid plastic or flexible material. The metal framework supports fluorescent lighting, which is the source of illumination. Typically in such sign systems the outer portion of the framework is hinged to permit access to the interior of the framework and allow the translucent face to be replaced. Examples of such sign systems are shown in U.S. Pat. Nos. 4,265,039, J. R. Brooks issued May 5, 1981, 4,267,657, W. Kloke issued May 19, 1981 and 4,542,605, James Gandy issued Sept. 24, 1985.

Such sign systems are intended to be mounted fairly permanently in an outdoor location, and do not allow the sign face to be readily changed. A skilled worker familiar with the sign system is required to carry out the change of the sign face.

Point-of-purchase advertising is found to be a very cost-effective method of advertising consumer products. A particularly effective form of point-of-purchase advertising is found to be the use of illuminated display signs showing the products of particular manufacturers to replace conventional aisle markers in grocery stores. For example, a sign merely indicating that a particular aisle number is the location of a particular food product can be replaced with an illuminated sign showing the aisle number and a photograph or color transparency of the food product of a particular manufacturer which is found on the aisle. Since the location and type of products in a grocery store is constantly changing, an illuminated sign for this purpose must necessarily allow quick and inexpensive changing of display faces. Signs which used rigid plastic faces prepared from color transparencies are found to be too expensive to be practical in this application.

SUMMARY OF THE INVENTION

The present invention provides an illuminated display sign in which the display faces may be rapidly and inexpensively changed. This display sign comprises a rigid framework extending around an opening, flexible material secured around the edge of the framework and defining a display face in the opening, means for generating illumination mounted in the framework, and a translucent or transparent flexible envelope which is adapted to receive a transparency and is further adapted to be slidably received in the display face defining material in order to support the transparency in position in the display face.

BRIEF DESCRIPTION OF THE DRAWINGS

In the drawings which illustrate an embodiment of the invention.

DETAILED DESCRIPTION OF AN EMBODIMENT OF THE INVENTION

Figure 7:
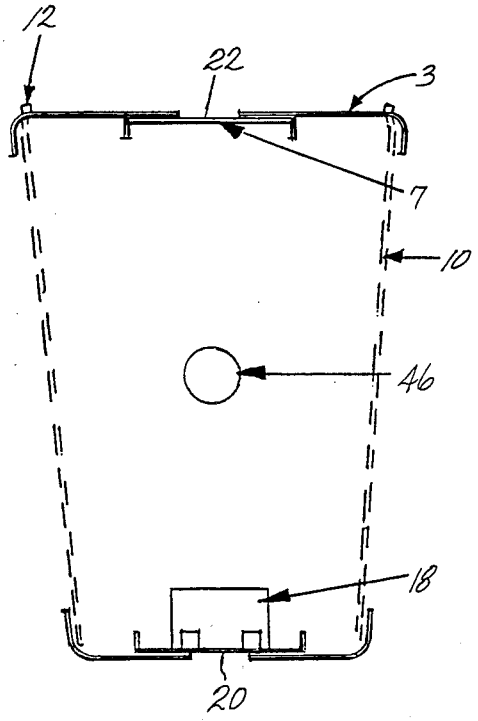
FIG. 7 is a cross-sectional view taken along lines B—B of FIG. 2.

Referring to FIGS. 1 through 4, the sign system of the invention includes a rectangular metal frame 7. This framework is constructed of an extruded alloy metal, such as aluminum. As can be seen in FIG. 7, it supports a ballast 18 on the lower panel of the frame 20, and a fluorescent tube 46, mounted between the end panels. The top panel of the frame is shown as 22 in FIG. 7. In the particular design illustrated in the drawings, the frame is not precisely rectangular, but is rectilinear, having a higher central portion, indicated by numeral 4 in FIG. 2.

Figure 3:
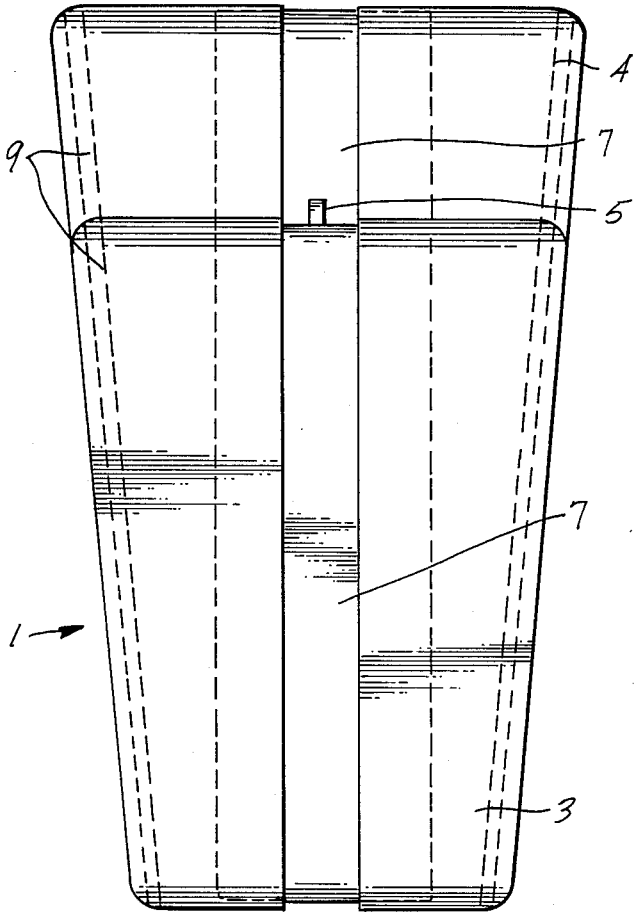
FIG. 3 is an end view of the sign system shown in FIG. 1.
Figure 6:
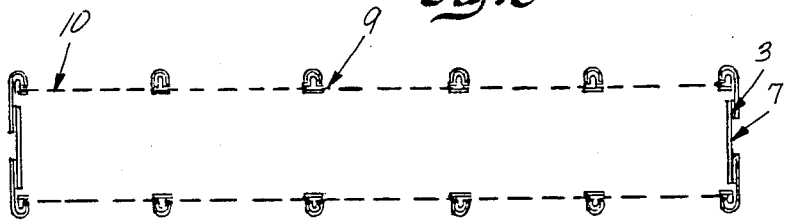
FIG. 6 is a cross-sectional view taken along lines A—A of FIG. 2.

The sign of the present invention, designated generally as 1, has a number of display faces 2 formed on both sides of the sign. The display faces are provided with translucent color sign messages which display the illuminated message when the source of illumination is turned on. The display faces are defined by a semi-rigid plastic casing 3 which is secured to and overlaps the metal framework 7 as shown in FIG. 3. The plastic casing is preferably formed of a synthetic material such as that sold under the trade mark KYDEX, a registered trade mark of the Rohm and Haas Company. The plastic casing may be secured to the metal framework by metal screws or the like. The individual display faces are defined by vertical sections of the KYDEX casing which protrude from the display face, shown in cross-section in FIG. 6.

Figure 4:
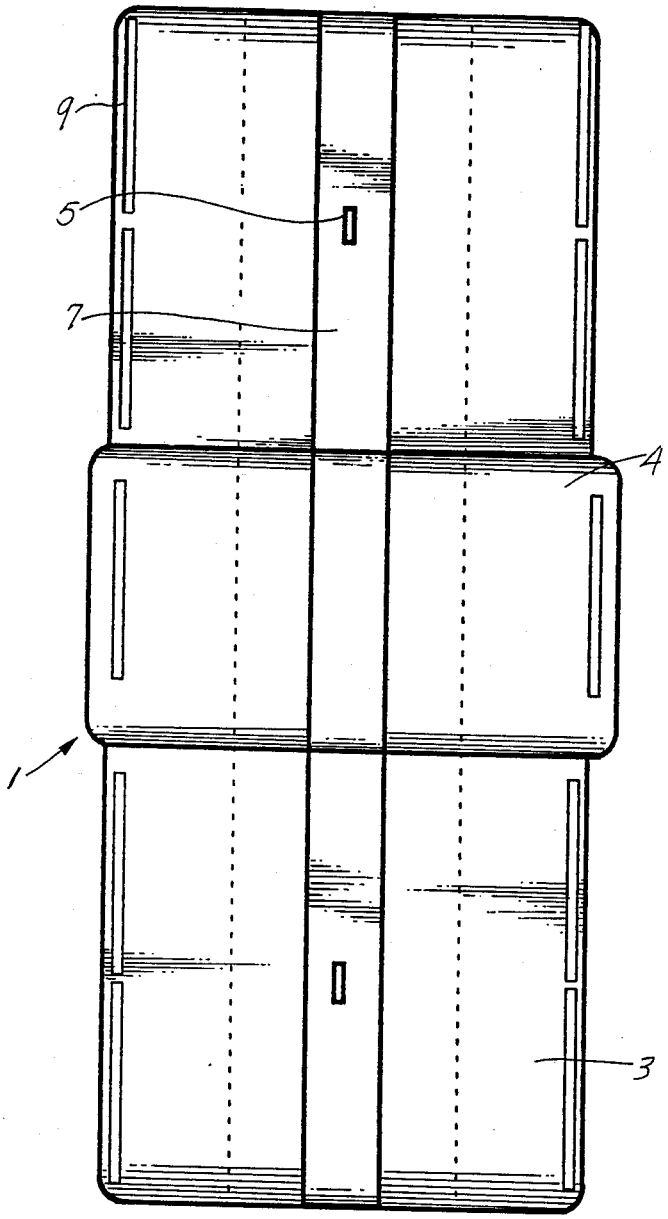
FIG. 4 is a top view of the sign system shown in FIG. 1.
Figure 5:
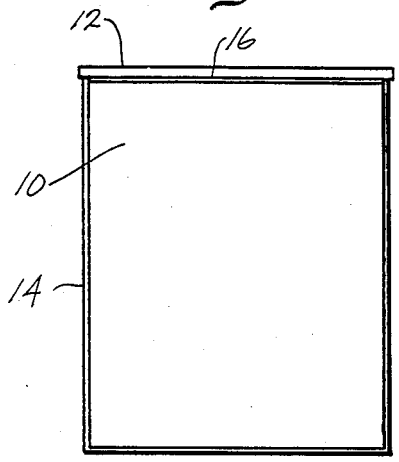
FIG. 5 is a front view of the envelope of the invention.

As shown in FIG. 4, the upper surface of the KYDEX casing is provided with a number of slots 9. Slots 9 are sized to receive the transparent plastic envelope 10 which is shown in FIG. 5. The plastic envelope is formed of two transparent sheets of BUTYRITE* or like material which are heat sealed around three edges 14. A pocket 16 is thus formed in the envelope. Attached to the top edge of the envelope is a plastic stopper 12 which is bonded to the envelope and which is sized to abut against the edges of slot 9 and prevent the envelope from sliding completely through slot 9. It has been found that a translucent material is also suitable for the envelope 10.

Figure 1:
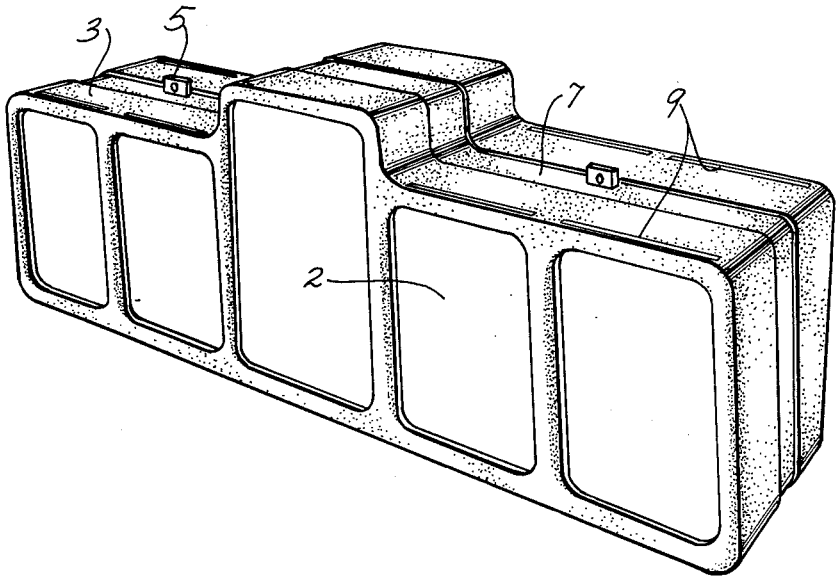
FIG. 1 is a perspective view of the illuminated sign system of the invention.
Figure 2:
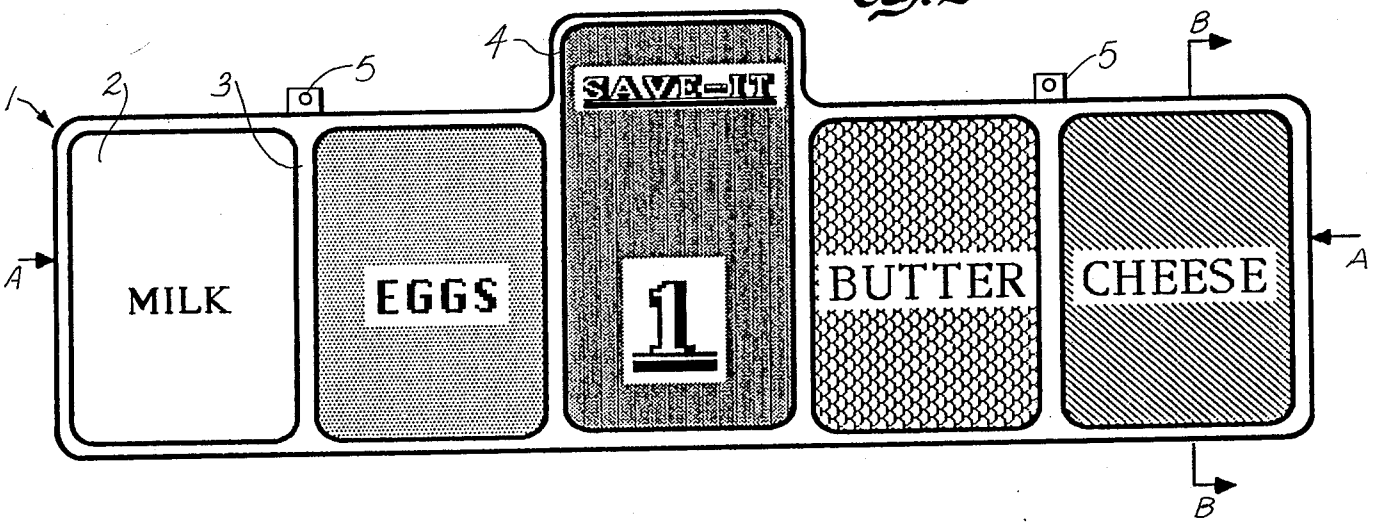
FIG. 2 is a front view of the sign system shown in FIG. 1.

Also known in FIGS. 2 through 4 are hook means 5 which allow the display sign to be hung from a ceiling. Alternatively, however, a single-sided display sign of the type disclosed may be attached directly to a wall surface. Similarly, a double-sided display sign of this type may be supported in some other way.

In order to install a particular sign message in the display face, a standard flexible color transparency of the appropriate size is slipped into envelope 10 and envelope 10 is in turn slid into slot 9 and into position in the display face 2. Alternatively, envelope 10 may be permanently fixed in slot 9. Other sign messages are similarly installed in the other display faces of the sign. To replace an existing sign message, the plastic envelope 10 is simply removed from slot 9, the flexible transparency is slipped out of the pocket 16 and is replaced with the new sign message in the form of another flexible color transparency. In this way it is not necessary to prepare expensive rigid plastic transparent faces.

A particularly useful application for the sign of the present invention is for point-of-purchase advertising in grocery stores. Shown in FIG. 2, the central display face is used to indicate the aisle number in the grocery store and the name of the grocer. The remaining faces may simply indicate the types of foods which are found on that particular aisle, but more usefully show color advertisements of the actual manufacturer's products which are carried in the store. The advertising fees paid by the manufacturer of the products provides an additional source of income for the store owner.

It will also be apparent that the display sign of the present invention can be formed of various lengths and sizes and including any number of display face sections. As will be apparent to persons skilled in the art, various modifications and adapations of the structure above described are possible without departure from the spirit of the invention, the scope of which is defined in the appended claims.

I claim:

1. An illuminated display sign comprising:

(a) a rigid framework having spaced upper and lower elongated frame elements joined between corresponding ends thereof by respective spaced elongated side support elements, thereby forming an opening lying in a plane;

(b) means mounted in said framework for generating illumination;

(c) a translucent sign display extending across said opening and comprising an image-bearing transparency and a light-transmitting envelope means for receiving and supporting said transparency wherein said envelope means is closed on three sides and open along the upper edge thereof, thereby forming a pocket; and (d) means secured to said framework for supporting said translucent sign display wherein said envelope means is adapted to be supported in said supporting means, and to removably receive said transparency, wherein said framework and said supporting means form a housing for said translucent sign display provided with an aperture communicating with said upper edge of said envelope and adapted to permit insertion and removal of said transparency.

2. The display sign of claim 1 wherein said envelope means comprises horizontal means secured to said upper edge of said envelope for abutting said supporting means to thereby support said envelope means.

3. The display sign of claim 1 wherein said supporting means comprises a flexible plastic casing defining a display face and sized to conform to the edges of said rigid framework.

4. The display sign of claim 3 wherein said flexible plastic casing is provided with a series of slots for receiving said transparency.

5. The display sign of claim 4 comprising at least two of said slots and at least two corresponding display faces.

6. An illuminated display sign comprising:

(a) a rigid framework having spaced upper and lower elongated frame elements joined between corresponding ends thereof by respective spaced elongated side support elements, thereby forming an opening lying in a plane;

(b) means mounted in said framework for generating illumination;

(c) a translucent sign display comprising an image-bearing transparency and a light-transmitting envelope means for receiving said transparency; and (d) means secured to said framework for supporting said translucent sign display wherein said envelope means is adapted to be received in said supporting means, and to removably receive said transparency; wherein said envelope means comprises horizontal means for abutting said supporting means to position said envelope means, and a light-transmitting pocket secured to said horizontal means for receiving said transparency.

* * * * *

UNITED STATES PATENT AND TRADEMARK OFFICE

CERTIFICATE OF CORRECTION

PATENT NO. : 4,848,016

DATED : July 18, 1989

INVENTOR(S) : David G. Downing

It is certified that error appears in the above-identified patent and that said Letters Patent is hereby corrected as shown below:

On the Front Page:

Assignee, change "P.O.P. Inc." to - - AD P.O.P. Inc. - - .

Signed and Sealed this

Sixth Day of November, 1990

*Attest:*

HARRY F. MANBECK, JR.

*Attesting Officer*

*Commissioner of Patents and Trademarks*